United States Patent [19]

Haworth et al.

[11] 3,990,204

[45] Nov. 9, 1976

[54] ALIGNMENT SYSTEM FOR WALL PANELS

[75] Inventors: Richard G. Haworth, Holland; Charles J. Saylor, Zeeland, both of Mich.

[73] Assignee: Haworth Mfg., Inc., Holland, Mich.

[22] Filed: Sept. 22, 1975

[21] Appl. No.: 615,729

[52] U.S. Cl. ..... 52/239; 52/758 D; 52/645; 52/242; 52/582

[51] Int. Cl.[2] ..... E04H 1/00; F16B 1/00

[58] Field of Search ..... 52/239, 241, 582, 698, 52/758 D, 753 K, 242, 235, 397, 645

[56] References Cited

UNITED STATES PATENTS

| | | | |
|---|---|---|---|
| 3,239,986 | 3/1966 | Russell | 52/753 K |
| 3,512,819 | 5/1970 | Morgan et al. | 52/753 K |
| 3,744,826 | 7/1973 | Hawes | 52/758 D |
| 3,894,316 | 7/1975 | Johnson | 52/758 D |

*Primary Examiner*—Ernest R. Purser
*Assistant Examiner*—Robert C. Farber
*Attorney, Agent, or Firm*—Woodhams, Blanchard and Flynn

[57] ABSTRACT

A wall system formed from a plurality of interconnected panels, which wall assembly incorporates an improved alignment structure coacting between the edges of adjacent panels for insuring proper vertical alignment of adjacent panels. The alignment structure includes an identical alignment member mounted on the vertical edge of each panel, which alignment member includes right and left portions each having a pair of substantially horizontal alignment plates disposed in vertically spaced relationship. The plates of the right and left portions are vertically offset so that one of the plates of the right portion is aligned with the slot formed between the plates of the left portion, and similarly one of the plates of the left portion is aligned with the slot defined between the plates of the right portion. When two wall panels are connected together, the right and left portions of the alignment member mounted on one wall panel respectively interfit with the left and right portions of the alignment member on the adjacent panel. The alignment members also permit the adjacent panels to be pivotally displaced relative to one another about a substantially vertical axis.

17 Claims, 14 Drawing Figures

ALIGNMENT SYSTEM FOR WALL PANELS

FIELD OF THE INVENTION

This invention relates to a wall system formed from a plurality of interconnected panels or partitions and, in particular, to an improved alignment structure which coacts between the edges of adjacent panels to facilitate the proper vertical alignment thereof.

BACKGROUND OF THE INVENTION

Wall systems formed from a plurality of interconnected, prefabricated and portable panels are well known. Such systems are being used extensively in office and other commercial buildings for dividing interior spaces into smaller work regions, thereby providing the desired privacy while reducing noise within the building, and at the same time improving the interior appearance. The adjacent panels in the known wall systems are normally connected by a hinge structure to permit the adjacent panels to be angularly positioned in the desired orientation. Some of these known wall systems have also relied upon this hinge structure for fixedly connecting the adjacent panels in the desired vertical relationship. While these hinge structures do provide for the desired vertical alignment, nevertheless these hinge structures are relatively expensive to manufacture and make interconnection of adjacent wall panels a laborous and difficult task.

In an attempt to overcome the above disadvantages, other known wall systems have utilized a simple hinge for connecting the adjacent wall panels to permit relative angular displacement therebetween. However, this simple hinge has not provided any structure for insuring vertical alignment between the adjacent panels, and thus these wall structures have normally relied upon adjustable support legs for leveling the panels and providing vertical alignment therebetween. While this structure is relatively simple and hence inexpensive, nevertheless the installation of the panels is somewhat time consuming since the vertical alignment between adjacent panels necessarily requires manual adjustment of the leveling legs after installation and assembly of the wall system, which adjustment is somewhat of a trial-and-error procedure.

Accordingly, it is an object of the present invention to provide an improved wall system which overcomes the above-mentioned disadvantages. Specifically, it is an object of this invention to provide a wall system formed from a plurality of prefabricated panels, which panels have alignment members fixedly mounted thereon adjacent the opposite ends thereof, whereby an alignment member on one panel cooperates with a further alignment member mounted on an adjacent panel to permit an efficient and accurate vertical alignment of adjacent panels during installation and assembly of the wall system.

A further object of this invention is to provide an improved wall system, as aforesaid, wherein an identical alignment member is mounted on each end of each panel, which alignment member has different right and left portions so that two of said alignment members when disposed in opposed relationship, will readily interfit one within the other.

Still a further object of this invention is to provide an improved wall system, as aforesaid, wherein the right and left portions of one alignment member interfit within the left and right portions, respectively, of a further identical alignment member so that a single identical alignment member can be provided on each end of each panel, thereby permitting any two panels to be connected end for end, and also permitting the panels themselves to be interchanged end for end, thereby facilitating the assembly of the wall system while providing the wall system with maximum flexibility and interchangeability.

Another object of this invention is to provide an improved wall system, as aforesaid, which incorporates an alignment structure which is simple and economical to manufacture, simple and economical to mount on the wall panels, and which permits simple installation and assembly of the wall system while permitting precise vertical alignment of adjacent panels.

Figure 1:
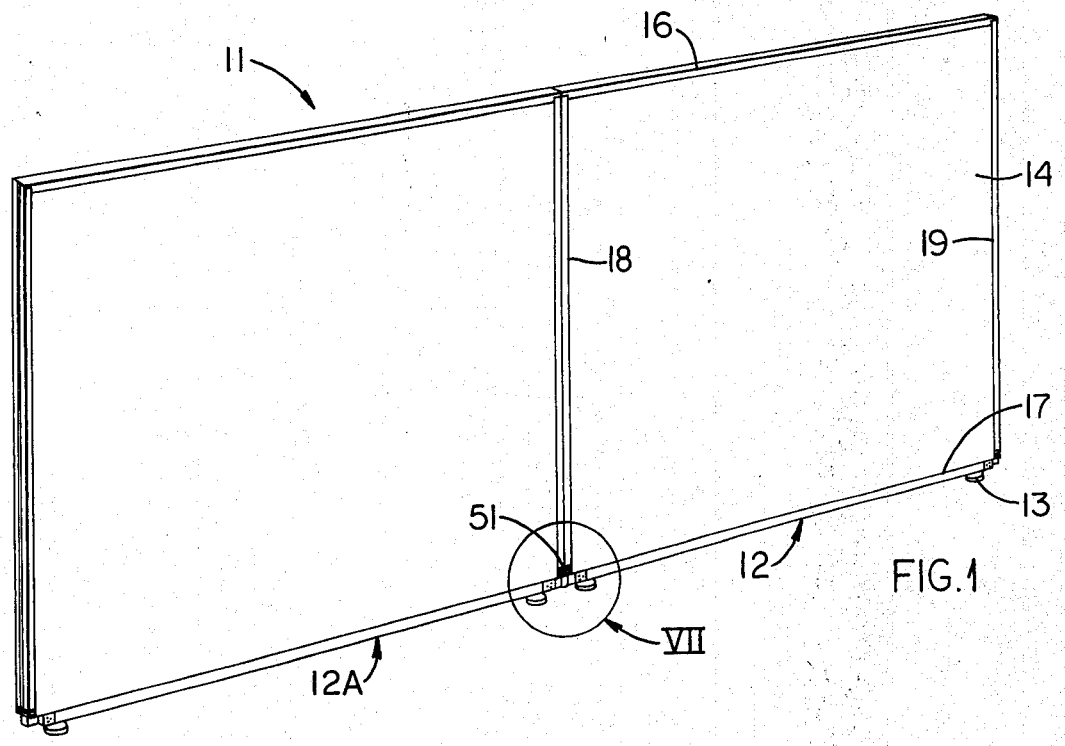
FIG. 1 is a perspective view of a wall system incorporating two interconnected panels therein.

Certain terminology will be used in the following description for convenience in reference only and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of a wall panel and designated parts thereof. Said terminology will include the words specifically mentioned, derivatives thereof and words of similar import.

SUMMARY OF THE INVENTION

The objects and purposes of the present invention are met by providing an improved wall system formed from a plurality of portable, prefabricated wall panels. The panels have their adjacent vertical edges joined together by a hinge structure which permits adjacent panels to be relatively individually displaced about a substantially vertical hinge axis. The two vertical edges of each panel are each provided with an identical alignment member mounted thereon. The alignment member has differing right and left alignment portions so that when two panels are interconnected, the two alignment members as disposed in opposed relationship on the adjacent vertical edges of the panels can be readily interfitted by means of the right and left portions on one alignment member interfitting within the left and right portions, respectively, on the other alignment member. These alignment members insure proper vertical alignment between adjacent panels, while permitting the adjacent panels to be relatively angularly displaced about the vertical hinge axis. The right and left portions of each alignment member preferably include a plurality of horizontal plates which are disposed in vertically spaced relationship with the plates in the right portion being vertically staggered or offset relative to the plates in the left portion.

DETAILED DESCRIPTION

FIG. 1 illustrates a part of a wall system 11 which is formed by a pair of substantially identical, prefabricated portable wall panels 11 and 11A. The panels are supported in an upright position on a support surface, such as a floor, by means of adjustable supports or feet 13. The panels have a pair of opposed and substantially planar side surfaces 14. While only two panels have been disclosed in FIG. 1, it will be appreciated that any desired number of panels can be connected together, with the adjacent panels being disposed in aligned or angled relationship relative to one another so as to provide for the desired orientation of the wall system.

Figure 2:
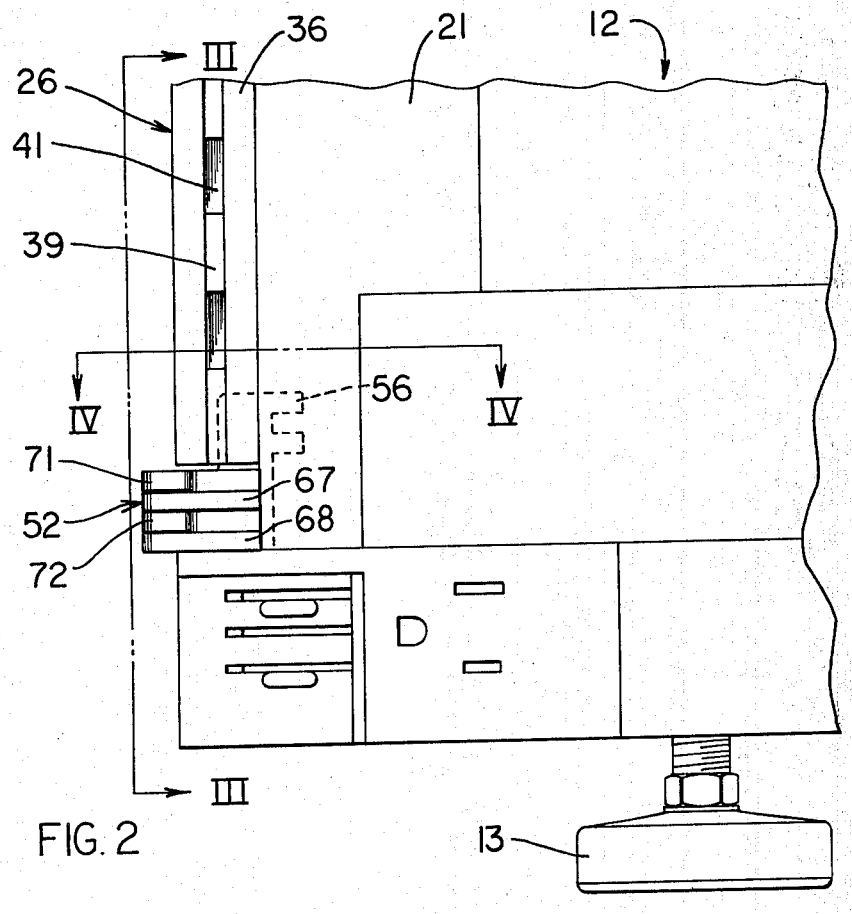
FIG. 2 is a fragmentary side view illustrating one corner of a panel having an alignment member thereon.
Figure 4:
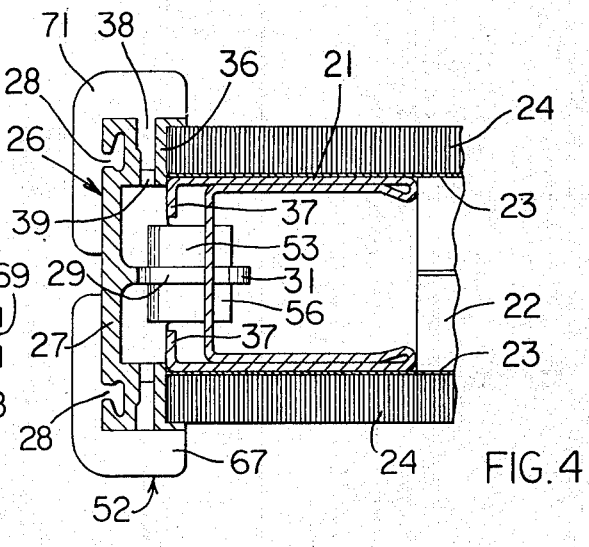

The panel 11 is of a substantially rectangular shape and is defined by substantially horizontally extending top and bottom edges 16 and 17, respectively, which edges in turn are joined by opposed vertically extending side or end edges 18 and 19. The panel has a rigid rectangular frame disposed internally thereof, which frame is formed from a plurality of substantially channel-shaped rails extending longitudinally along each of the panel edges. One such channel-shaped rail 21, as associated with the vertical edge 18, is illustrated in FIGS. 2 and 4. The rectangular frame has a pair of thin facing sheets 23 (FIG. 4) disposed on and fixedly secured to the opposite sides of the frame, which facing sheets are normally of sheet metal or pressed board, and confine therebetween a honeycomb core 22 which occupies the region within the rectangular frame. The facing sheets 23 are additionally covered by a suitable exterior material, such as a layer of carpet or fabric 24.

Figure 3:
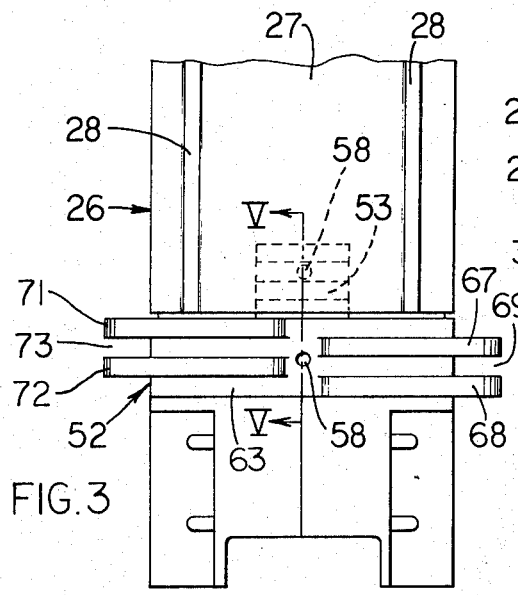
FIGS. 3 and 4 are fragmentary elevational views along the lines III—III and IV—IV, respectively, in FIG. 2.

The vertical side edge 18, and the opposite identical side edge 19, is formed by an elongated end cap 26 (FIGS. 2–4) which is fixed to and extends longitudinally along the adjacent side rail 21. The end cap 26 is of a channel-shaped cross section and extends throughout substantially the complete height of the panel. Cap 26 has an exterior web or wall 27 which extends transversely across the width of the panel and is provided with a pair of grooves 28 formed adjacent the opposite edges thereof. These grooves 28 extend over a major portion of the length of the end cap. A center flange 29 is fixed to and projects inwardly from the wall 27 and terminates in a plurality of downwardly directed, L-shaped hooks 31. The hooks 31 extend through slots 32 (FIG. 8) formed in the web 33 of the side rail 21 for fixedly mounting the end cap 26 on the adjacent side rail 21.

End cap 26 also has a pair of L-shaped flanges 36 which are disposed rearwardly from the wall 27 and are positioned for engagement with the flanges 37 formed on the side rail 21. The L-shaped flanges 36 also project outwardly so as to overlap the outer corners or edges of the carpet layers 24. These flanges 36 are separated from the wall 27 by intermediate grooves 38 which extend longitudinally of the end cap, and a web 39 joins each flange 36 to the web 27. The web 39 has a plurality of elongated slots 41 (FIG. 2) formed therethrough, which slots communicate with the groove 38. The groove 38 and slots 41 accommodate therein brackets associated with auxiliary equipment which is to be mounted on the wall panel, which equipment may comprise file cabinets, book shelves and the like. This equipment and the manner in which it is mounted on wall panels of this general type is well known.

Figure 8:
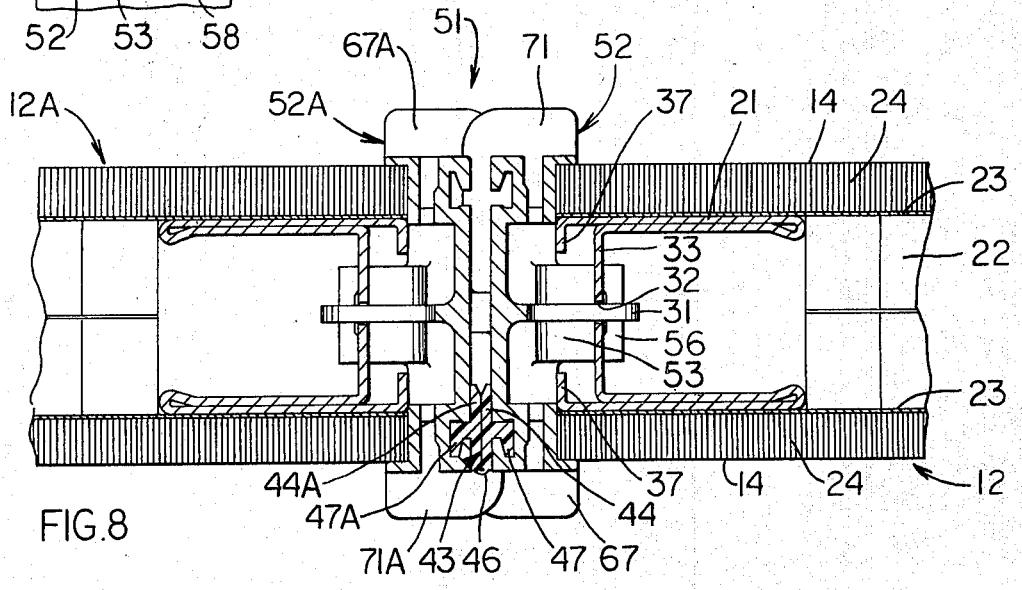
FIG. 8 is a fragmentary sectional view along line VIII—VIII in FIG. 7.

The elongated grooves 28 as framed on the end cap 26 accommodate therein a part of the hinge member 43 which, as illustrated in FIG. 8, coacts with the end caps 26 and 26A of two adjacent panels 12 and 12A for permitting the two panels to be hingedly connected together. The hinge member 43 includes a pair of hinge plates 44 and 44A joined together by a hinge portion 46 which permits the two hinge plates to be selectively angularly displaced relative to one another. The hinge plates 44 and 44A respectively have L-shaped flanges 47 and 47A secured thereto, which flanges are accommodated within the grooves 28 formed in the end caps.

The hinge member 43 is preferably extruded from a plastic material and comprises a one-piece elongated member which extends vertically along the adjacent edges of the panels throughout substantially the complete height thereof. The hinge portion 46 is formed by providing a portion of reduced thickness between the two hinge plates, which intermediate portion 46 is sufficiently flexible so as to define a vertical hinge axis. The elongated hinge member 43 is slidably accommodated on the end caps due to reception of the L-shaped flanges 47 and 47A into the grooves 38 associated with the respective end caps 26 and 26A. This slidable relationship accordingly does not restrain relative vertical movement between the adjacent panels.

The structure of the panel, as briefly described above, is illustrated and described in substantially greater detail in copending application Serial No. 615,506 (attorney's reference: MPI Case 1) filed Sept. 22, 1975 which application is assigned to the Assignee of this application.

Considering now the alignment structure 51, the panel 12 has an alignment member 52 fixedly associated therewith adjacent the lower end of the vertical side edge 18, and a further identical alignment member is fixedly associated with the other vertical side edge 19, which alignment members are mounted in identical positions adjacent the opposite lower corners of the panel.

The alignment member 52 includes a central block-like mounting portion 53 which is adapted to be positioned between the spaced outer flanges 37 as formed on the rail 21, whereby the mounting portion 53 is confined between the flanges 37 and bears against the web 33. The mounting portion 53 has a pair of substantially parallel and spaced-apart flanges 56 projecting rearwardly therefrom, which flanges project through a pair of slots 57 as formed in the web 33 so as to properly position the alignment member 52 on the rail 21. A pair of screws 58 extend through suitable openings 59 formed in the alignment member for fixedly securing the alignment member to the rail 21.

Alignment member 52 includes right and left alignment portions 61 and 62, respectively, which portions are of similar construction but are not mirror images of one another. The right and left alignment portions are associated with a rear wall 63 which projects outwardly on opposite sides of the mounting portion 53 and has a recess 64 formed in the rearward side thereof, which recess 64 results in flanges 66 which overlap the outer corners or edges of the carpet layers 24. The rear wall 63 of the alignment member thus extends across the width of the panel and accommodates the width of the panel within the recess 64.

Figure 5:
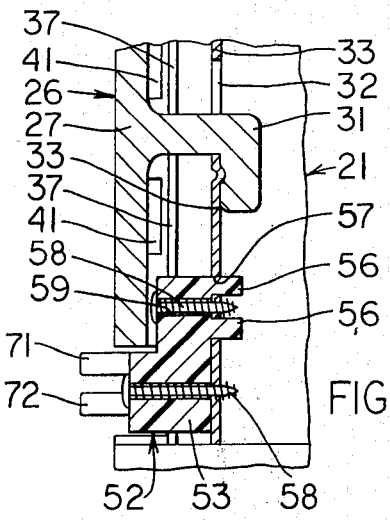
FIG. 5 is a fragmentary sectional view taken along line V—V in FIG. 3.
Figure 6:
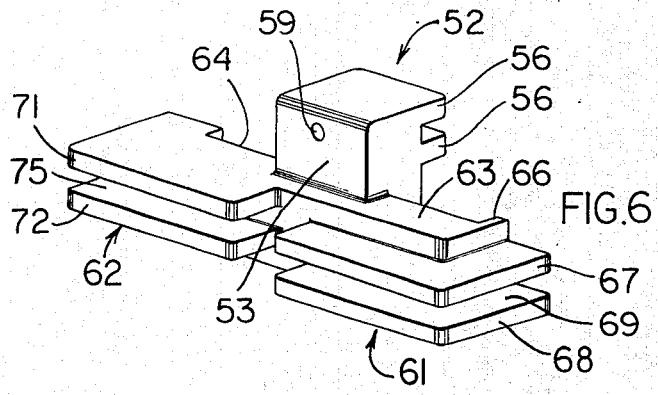
FIG. 6 is a perspective view of the alignment member.

The right alignment portion 61 includes a pair of substantially parallel horizontal plates 67 and 68, which plates project outwardly and sidewardly of the end wall 63 and are disposed vertically above one another, being spaced apart by an intermediate slot 69. The lowermost horizontal plate 68 is substantially flush with the lower surface of the alignment block, whereas the upper plate 67 is spaced downwardly from the upper surface of the end wall 63 as illustrated in FIG. 5.

The left alignment portion 62 is of similar construction in that it also includes a pair of substantially parallel horizontal plates 71 and 72 projecting outwardly and sidewardly from the end wall 63. The plates 71 and 72 are disposed vertically above one another and are spaced apart by an intermediate slot 73 therebetween. The upper plate 71 is substantially flush with the upper surface of the end wall 63, as shown in FIG. 5, whereas the lower plate 72 is spaced upwardly from the lower surface of the alignment member.

The lower plate 72 as associated with the left alignment portion 62 is substantially horizontally aligned with the slot 69 as formed between the right alignment plates 67 and 68, and in a similar manner the upper right alignment plate 67 is horizontally aligned with the slot 73 formed between the left alignment plates 71 and 72. The slots 69 and 73 are of substantially equal vertical width, which width is substantially equal to, but normally slightly greater than, the vertical thickness of the plates 67 and 72. The lower right alignment plate 68 is aligned with an open space which is formed below the lower left alignment plate 72, and the upper left alignment plate 71 is similarly aligned with an open space which is disposed above the upper right alignment plate 67.

OPERATION

Figure 7:
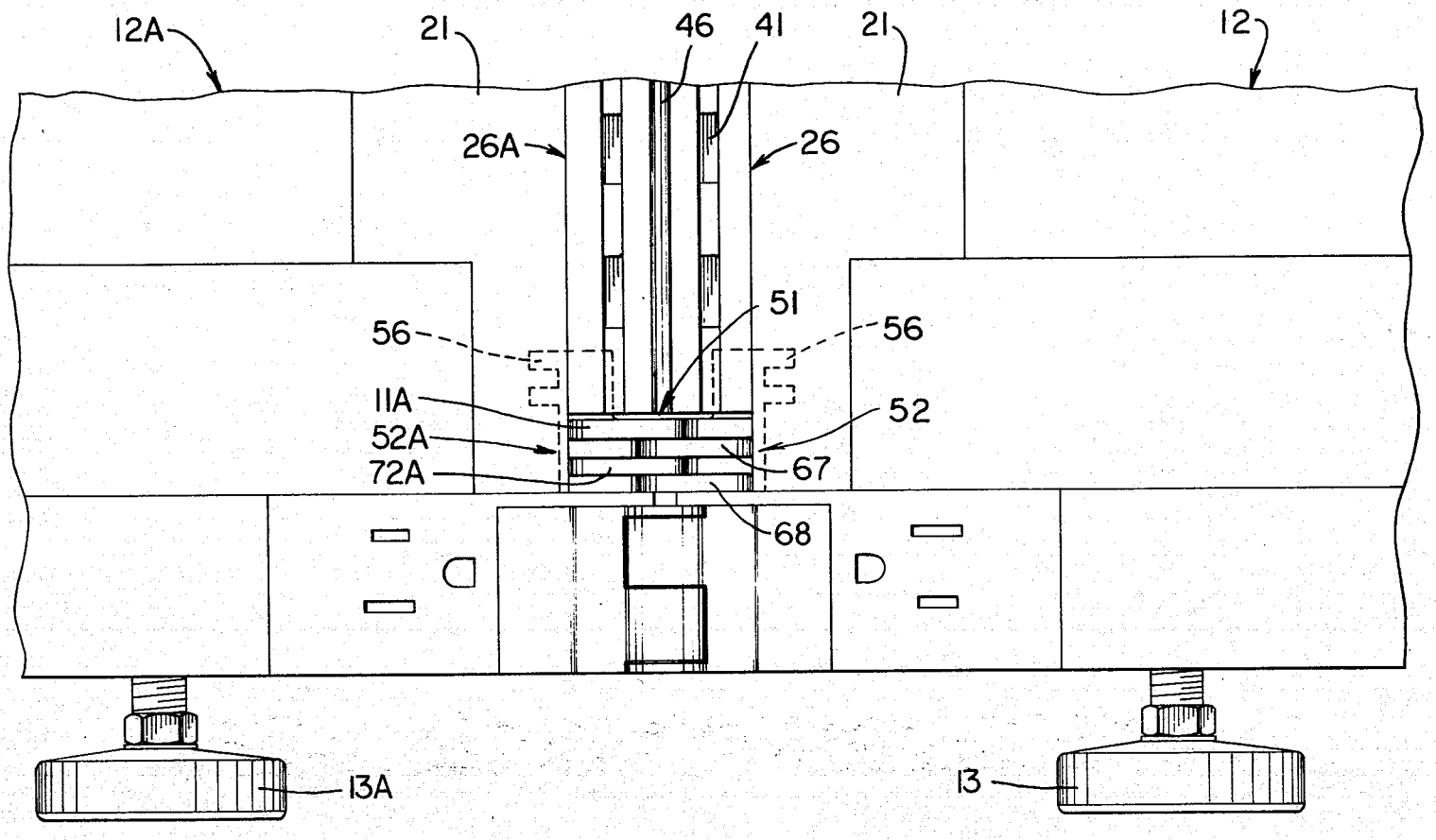
FIG. 7 is an enlarged, fragmentary side view of the area enclosed within the circle designated VII in FIG. 1.

When two adjacent panels 12 and 12A are to be connected together, then the alignment members 52 and 52A as disposed on the opposed adjacent edges of the panels interfit with one another as illustrated in FIGS. 7 and 8. That is, the right and left alignment portions of the alignment member 51 respectively interfit within the left and right alignment portions of the alignment member 52A. Thus, the right upper alignment plate 67 of the member 52 enters into the left slot 73 associated with the alignment member 52A, and similarly the lower left alignment plate 72 of the alignment member 52A enters into the slot 69 associated with the right portion of the alignment member 52. The horizontal plates of the opposed alignment portions thus interleaf or interfit in a snug manner to insure that the adjacent panels are properly vertically aligned, as illustrated in FIG. 7. The alignment structure 51 thus provides for a guaranteed vertical alignment between the adjacent panels without having to rely upon adjustment of the feet 13.

Figure 9:
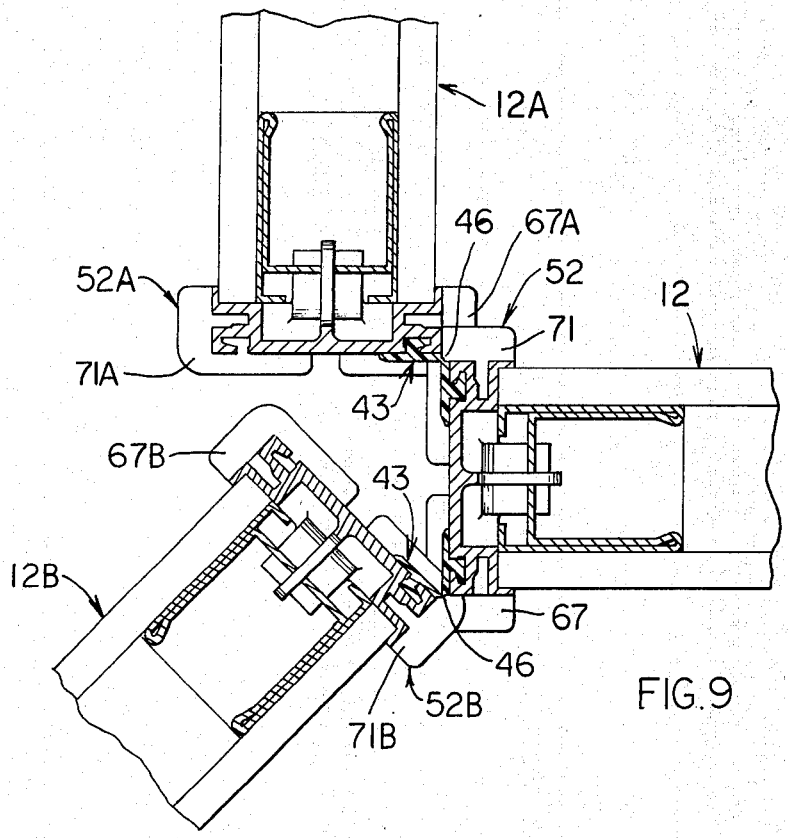
FIG. 9 is a fragmentary view of a variation.
Figure 14:
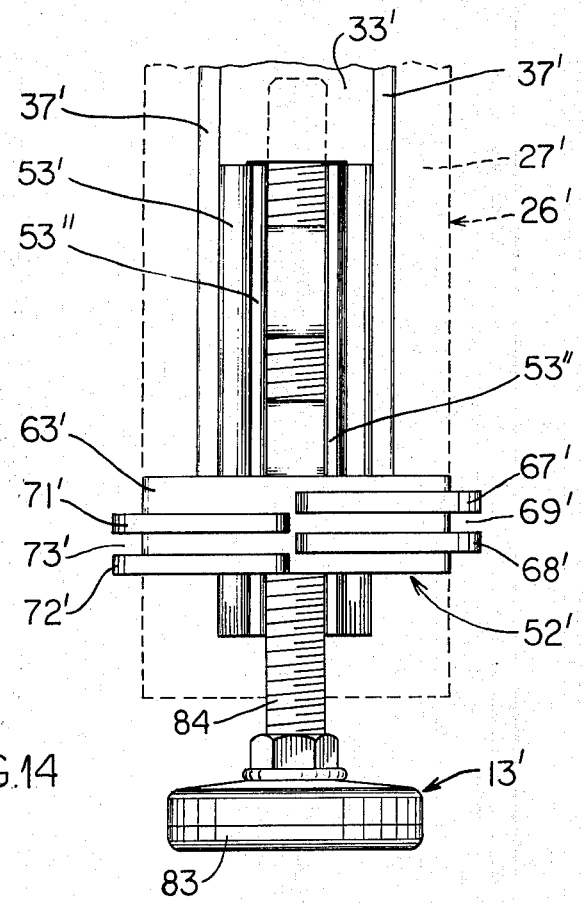
FIG. 14 is a view along line XIV—XIV in FIG. 11.
Figure 10:
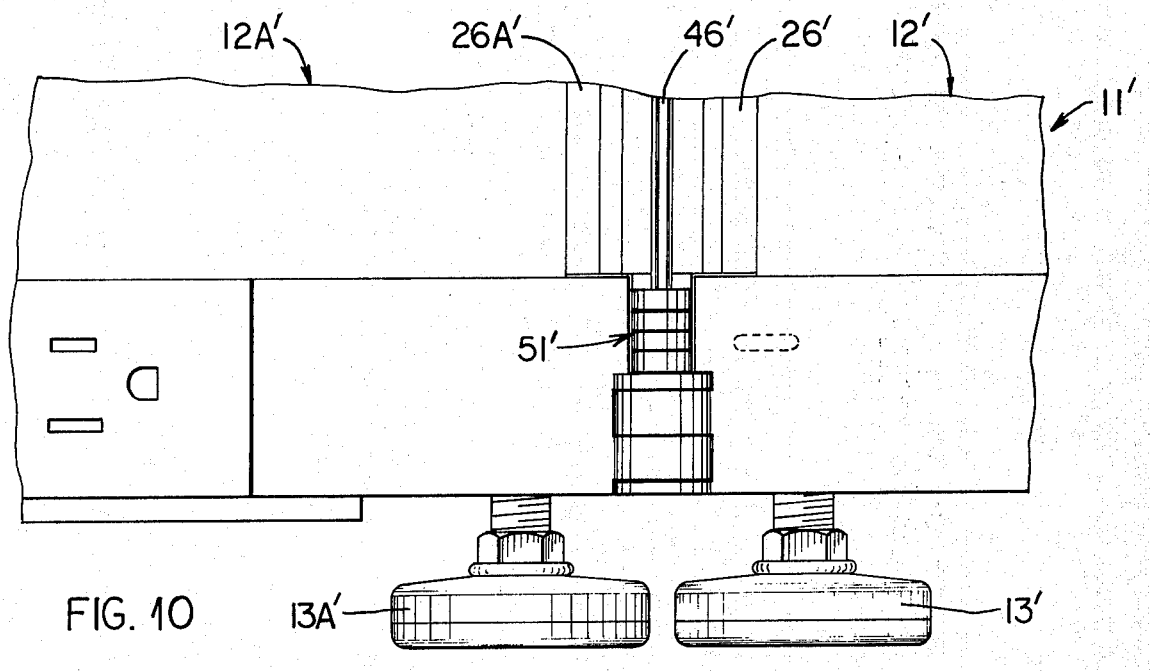
FIG. 10 is a view similar to FIG. 7 but illustrates a modified alignment and support leg structure.
Figure 11:
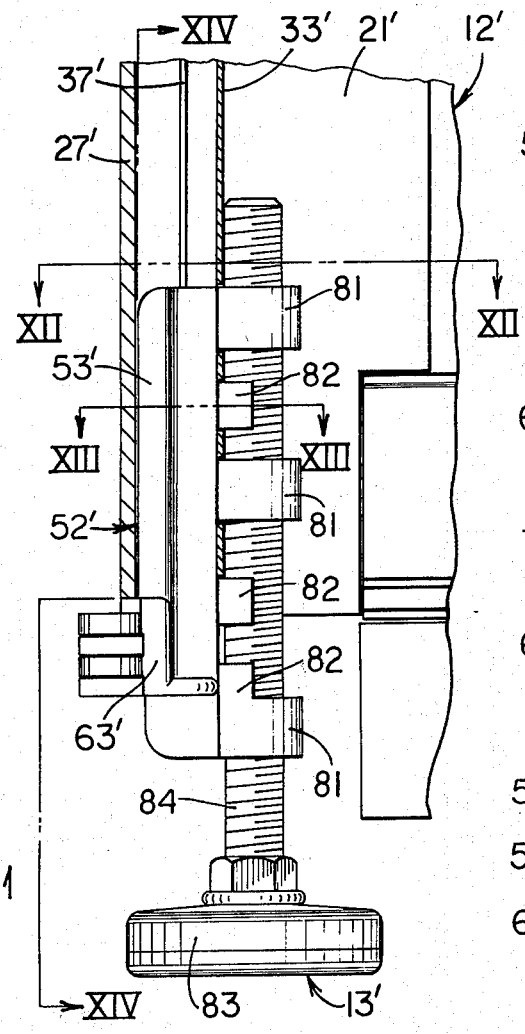
FIG. 11 is a fragmentary elevational view of the structure appearing in FIG. 10, which view has a portion of the side rail broken away for purposes of illustration.
Figure 12:
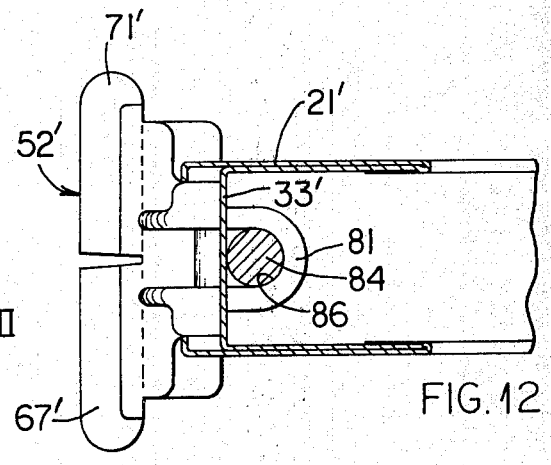
FIGS. 12 and 13 are fragmentary sectional views along the line XII—XII and XIII—XIII, respectively, in FIG. 11.
Figure 13:
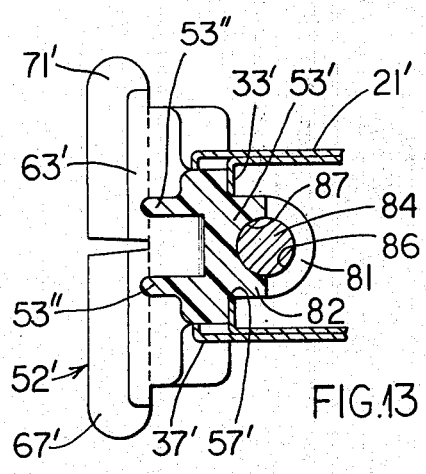

The alignment structure 51 also permits adjacent interconnected panels to be disposed in angled relationship with respect to one another while still providing for proper vertical alignment therebetween. For example, as illustrated in FIG. 9, when the panels 12 and 12A are disposed angled with respect to one another, such as substantially perpendicular, then the adjacent panels 12 and 12A are properly vertically aligned due to the left portion of the alignment member 52 being engaged with the right portion of the alignment member 52A associated with the panel 12A. This alignment structure also permits three different panels to be joined at a single junction, since a further panel 12B as illustrated in FIG. 9 can also be connected to the panel 12. For this purpose, the alignment member 52B associated with the panel 12B has the left portion thereof interfitted with the right portion of the alignment member 52.

The alignment structure 51 permits the panels to be angled with respect to one another since the vertical hinge axis 46 intersects the respective alignment portion at a location which is closely adjacent, but slightly spaced outwardly from, the end wall 63. Thus, the alignment member does not interfere with, or restrict, the free relative swinging movement between the panels as permitted by the hinge member 43. However, the lower end of the hinge member 43 bears against the upper surface of the end wall 63 to thereby properly vertically retain the hinge member within the grooves formed in the end caps.

The alignment members are preferably manufactured of a synthetic material, such as a plastic material, as by being molded.

MODIFICATION

FIGS. 10–14 illustrate a wall panel having a modified alignment structure associated therewith, which alignment structure cooperates with the adjustable legs or supports. The modified structure of FIGS. 10–14 has been designated by the same reference numerals used to designate the corresponding parts of FIGS. 1–9, except for the addition of a prime (′) thereto.

The wall system 11′ of FIGS. 10–14 is substantially identical to the wall system 11 described above except for the specific configuration of the alignment member 52′ and the manner in which it cooperates with the adjustable support leg 13′.

The alignment member 52′, in this embodiment, also includes a rear wall 63′ which extends transversely across the width of the panel and has the substantially horizontal alignment plates 67′, 68′, 71′ and 72′ projecting therefrom. The plates 67′ and 68′ are disposed on the right side of the alignment member and are vertically spaced apart by the intermediate slot 69′, whereas the plates 71′ and 72′ are mounted on the left side of the alignment member and are vertically spaced apart by the slot 73′. The left and right plates are also vertically staggered so that the left alignment plate 71′ is horizontally aligned with the slot 69′, and the right alignment plate 68′ is horizontally aligned with the slot 73′. This structure is thus substantially identical to the alignment structure of FIGS. 1–9.

To mount the alignment member 52′ on the panel 12′, same is provided with a central mounting portion 53′ which is fixed to the rear wall 63′. The mounting portion 53′ is, in this embodiment, of substantial vertical extent and extends between the outer flanges 37′ on the side rail 21′ so as to bear against the web or central wall 33′ thereof. The mounting portion 53′ is of a substantially channellike configuration and has a pair of spaced legs or flanges 53″ extending longitudinally thereof, which legs substantially bear against the outer wall or web 27' of the end cap 26', whereby the alignment member 52' is confined between the webs 27' and 33'. Mounting portion 53' has three yokelike flanges 81 projecting therefrom at vertically spaced intervals, and three further flanges 82 also project transversely of the mounting portion so as to be disposed between the yokelike flanges 81. The two uppermost yokelike flanges 81 and the uppermost flange 82 all project through rectangular slots 57' as formed in the web 33', whereby the alignment member 52' is prevented from moving with respect to the rail 21' in the longitudinal direction thereof.

To fixedly secure the alignment member 52' with respect to the rail 21', the adjustable leg or support 13' is provided with a threaded shank or shaft 84 which projects upwardly from an enlarged foot 83. The shaft 84 projects into the interior of the channel-shaped side rail 21' so that the shaft 84 is disposed closely to the inner surface of the web 33'. Threaded shaft 84 extends through the yokelike flanges 81 and creates three axially spaced areas of threaded engagement therebetween, namely the thread areas 86, which area extends through an angle of approximately 180° in view of the substantially semi-cylindrical configuration of the yokelike flanges 81. The threaded shaft 84 also creates three axially spaced areas 87 of threaded engagement with the outer free ends of the flanges 82, which thread areas 87 are formed within the semi-cylindrical recesses formed in the outer free ends of the flanges 82. The thread areas 86 and 87 thus each extend through an angle of about 180°, and these thread areas 86 and 87 are substantially diametrically opposed (although they are axially spaced) so as to thus securely threadably connect the shaft 84 to the alignment member 52'.

The alignment member 52' is preferably constructed of a nonmetallic material, such as by being molded of a plastics material, whereupon the shaft 84 will thus cause a self-threading in the areas 86 and 87 when coupled to the alignment member.

The manner in which the alignment member 52' coacts with a further opposed alignment member mounted on the end of an adjacent panel is identical to the structure and operation explained above with respect to FIGS. 1–9.

The alignment member and its cooperation with the adjustable support leg, as illustrated in FIGS. 10–14, is highly desirable since this results in the support legs being directly under the outer corners of the panel, whereupon the weight of the panel is transmitted directly to the support legs so as to provide for a more stable support of the panel. In addition, the threaded coaction between the alignment member and the support leg results in both the alignment member and support leg being fixedly mounted on the panel so that additional structure for individually mounting the alignment member and the support leg on the panel is not required. The connection of the alignment member to the support leg, as illustrated in FIGS. 10–14, thus results in a more economical and efficient construction and assembly of the panel.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a portable, prefabricated wall panel having upper and lower substantially horizontally extending edge means joined by a pair of substantially vertically extending side edge means, said panel being of a substantially rectangular configuration and having a pair of enlarged and substantially planar outer surfaces on opposite sides thereof, said panel being adapted for connection to one or more further such panels for forming a wall system, the improvement comprising an identical alignment member fixedly mounted on each side edge means of said panel, said alignment member having first and second portions which are horizontally spaced from one another and are disposed adjacent the opposite sides of the panel, said first portion including first and second vertically spaced parts having a slot of preselected size therebetween, and second portion including a third part which is horizontally aligned with said slot and has a vertical dimension no greater than the vertical width of said slot, the space directly above and below said third part being open, whereby two of said alignment members when disposed in opposed relationship can be interfitted one within the other due to the third part on one alignment member fitting into the slot in the other alignment member, and due to the third part on said other alignment member fitting into the slot in said one alignment member.

2. A wall panel according to claim 1, wherein at least one of said parts comprises a substantially horizontally extending platelike portion projecting outwardly from the respective side edge means.

3. A wall panel according to claim 1, wherein said first and second parts respectively comprise first and second substantially horizontal platelike portions disposed in vertically spaced relationship and projecting horizontally outwardly from the respective side edge means, and said third part comprising a third substantially horizontally projecting platelike portion projecting outwardly from the respective side edge means, said third platelike portion having a vertical thickness approximately equal to the vertical spacing between said first and second platelike portions.

4. A wall panel according to claim 1, wherein said second portion includes a fourth part vertically spaced from said third part and defining a second slot therebetween which is substantially aligned with one of said first and second parts.

5. A wall panel according to claim 4, wherein said first and second parts respectively comprise first and second platelike portions which project substantially horizontally, said first and second platelike portions being vertically spaced by having said first-mentioned slot disposed therebetween, said third and fourth parts respectively comprising third and fourth platelike portions which project substantially horizontally and are vertically spaced by having said second slot therebetween, one of said first and second platelike portions being horizontally aligned with said second slot, and one of said third and fourth platelike portions being horizontally aligned with said first-mentioned slot, and first-mentioned and second slots being of substantially the same vertical width.

6. A wall panel according to claim 1, wherein a hinge member is mounted on at least one of the side edge means of said panel for defining a substantially vertical hinge axis, said hinge member being independent of said alignment members.

7. A wall panel according to claim 6, wherein said one side edge means has a vertically elongated groove formed therein, and said hinge member comprising a vertically elongated element having a portion thereof disposed within said groove.

8. A wall panel according to claim 7, wherein said hinge member is constructed in one piece of a plastic material and has first and second platelike portions joined by a flexible portion.

9. In a wall structure formed from a plurality of portable prefabricated partitions of substantially rectangular configuration, and hinge means for joining the adjacent vertical edges of said partitions together to permit relative angular displacement between the adjacent partitions about a substantially vertical extending hinge axis located in the vicinity of the adjacent vertical edges, the improvement comprising:

alignment means coacting between the adjacent vertical edges of first and second partitions for maintaining said first and second partitions vertically aligned with respect to one another, said alignment means being independent of said hinge means;

said alignment means including a first alignment member fixedly associated with the vertical edge of said first partition, and a second alignment member fixedly associated with the vertical edge of said second partition, said first and second alignment members being interengaged for preventing relative vertical movement between the adjacent vertical edges of said first and second partitions.

10. A wall structure according to claim 9, wherein said hinge means imposes no restraint between said first and second panels in the vertical direction.

11. A wall structure according to claim 9, wherein said first and second alignment members are identical.

12. A wall structure according to claim 11, wherein each said alignment member includes first and second alignment portions disposed adjacent the opposite sides of the respective partition, said first and second alignment portions being of compatible configuration so that the first and second portions of the first alignment member can respectively interfit with the second and first portions of the second alignment member.

13. A wall structure according to claim 12, wherein said first alignment portion includes first and second substantially horizontally extending plates disposed vertically above one another and spaced apart by a first slot therebetween, and wherein said second alignment portion includes a third substantially horizontally extending plate which is horizontally spaced from said first and second plates and is disposed substantially horizontally aligned with said first slot.

14. A wall structure according to claim 13, wherein said second alignment portion includes a fourth substantially horizontally extending plate spaced vertically from said third plate so as to define a second slot therebetween, said second slot being substantially horizontally aligned with one of said first and second plates.

15. A wall panel according to claim 1, including a support foot mounted adjacent each lower corner of said panel, said support foot including an enlarged foot portion adapted to engage a support surface, such as the floor, and a vertically elongated threaded shaft portion fixed to and projecting upwardly from the foot portion, said threaded shaft portion being threadably engaged with said alignment member.

16. A wall panel according to claim 15, wherein said side edge means includes a vertically extending channellike rail having a web portion extending across the width of the panel, said alignment member being disposed adjacent the outer side of said web and positioned in abutting engagement therewith, said alignment member having a plurality of flanges projecting through slots formed in said web, and said threaded shaft being disposed adjacent said web on the side thereof opposite said alignment member, said threaded shaft being threadably engaged with said flanges.

17. In a portable, prefabricated wall panel having upper and lower substantially horizontally extending edge means joined by a pair of substantially vertically extending side edge means, said panel being of a substantially rectangular configuration and having a pair of enlarged outer surfaces on opposite sides thereof, said panel being adapted for connection to one or more further such panels for forming a wall system, the improvement comprising an identical alignment member fixedly mounted on each side edge means of said panel, said alignment member having first and second portions which are horizontally spaced from one another and are disposed adjacent the opposite sides of the panel, said first portion including a first part having a lower surface, the space directly below said lower surface being open, said second portion including a second part which is vertically spaced downwardly from said first part, said second part having an upper surface which is approximately horizontally aligned with the lower surface on said first part, the space directly above the upper surface of said second part being open, whereby two of said alignment members when disposed in opposed relationship can be interfitted one within the other due to the second part on one alignment member fitting into the open space below the first part on the other alignment member, and due to the second part on said other alignment member fitting into the open space below the first part on said one alignment member.

* * * * *

UNITED STATES PATENT AND TRADEMARK OFFICE

CERTIFICATE OF CORRECTION

PATENT NO. : 3 990 204

DATED : November 9, 1976

INVENTOR(S) : Richard G. Haworth et al

It is certified that error appears in the above-identified patent and that said Letters Patent are hereby corrected as shown below:

Column 3, line 19; change "11 and 11A" to ---12 and 12A---.

Column 3, line 29; change "panel 11" to ---panel 12---.

Column 8, line 19; before "second" insert ---said---.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*